US006564552B1

(12) United States Patent
Ward et al.

(10) Patent No.: US 6,564,552 B1
(45) Date of Patent: May 20, 2003

(54) DRIFT STABILIZER FOR RECIPROCATING FREE-PISTON DEVICES

(75) Inventors: William C. Ward, Santa Fe, NM (US); John A. Corey, Melrose, NY (US); Gregory W. Swift, Santa Fe, NM (US)

(73) Assignee: The Regents of the University of California, Los Alamos, NM (US)

( * ) Notice: Subject to any disclaimer, the term of this patent is extended or adjusted under 35 U.S.C. 154(b) by 0 days.

(21) Appl. No.: 09/844,177

(22) Filed: Apr. 27, 2001

(51) Int. Cl.[7] ..... F02G 1/06
(52) U.S. Cl. ..... 60/520; 123/46 R
(58) Field of Search ..... 60/532, 494, 520; 123/46 R

(56) References Cited

U.S. PATENT DOCUMENTS

| | | | | |
|---|---|---|---|---|
| 4,450,685 A | | 5/1984 | Corey | 60/520 |
| 4,589,380 A | | 5/1986 | Coad | 123/46 R |
| 4,717,405 A | | 1/1988 | Budiger | 62/6 |
| 4,750,871 A | | 6/1988 | Curwen | 417/418 |
| 4,888,951 A | * | 12/1989 | Beale | 60/520 |
| 5,222,877 A | | 6/1993 | Benschop et al. | 417/410 |
| 5,287,827 A | | 2/1994 | Almendinger et al. | 123/46 R |

* cited by examiner

*Primary Examiner*—Edward K. Look
*Assistant Examiner*—Thomas E. Lazo
(74) *Attorney, Agent, or Firm*—Ray G. Wilson

(57) ABSTRACT

A free-piston device has a stabilized piston drift. A piston having a frequency of reciprocation over a stroke length and with first and second sides facing first and second variable volumes, respectively, for containing a working fluid defining an acoustic wavelength at the frequency of reciprocation. A bypass tube waveguide connects the first and second variable volumes at all times during reciprocation of the piston. The waveguide has a relatively low impedance for steady flow and a relatively high impedance for oscillating flow at the frequency of reciprocation of the piston, so that steady flow returns fluid leakage from about the piston between the first and second volumes while oscillating flow is not diverted through the waveguide. Thus, net leakage about the piston is returned during each stroke of the piston while oscillating leakage is not allowed and pressure buildup on either the first or second side of the piston is avoided to provide a stable piston location.

10 Claims, 5 Drawing Sheets

DRIFT STABILIZER FOR RECIPROCATING FREE-PISTON DEVICES

STATEMENT REGARDING FEDERAL RIGHTS

This invention was made with government support under Contract No. W-7405-ENG-36 awarded by the U.S. Department of Energy. The government has certain rights in the invention.

FIELD OF THE INVENTION

The present invention relates generally to free-piston devices, and, more particularly, to free-piston devices having reciprocating pistons with drift stabilization.

BACKGROUND OF THE INVENTION

Free-piston power conversion devices (engine-generators, gas compressors, and closed-cycle cooling machines) have been long known. Typically, such machines incorporate at least one internal, reciprocating piston that seals the internal volume into two spaces. The piston reciprocates, typically at resonant conditions, with a pressure wave generated by the change of volume during reciprocation in the two spaces sealed apart by the piston. Because one great advantage of such devices is their ability to operate fully sealed for long periods, and especially in engine applications where part of the system may be held at high temperature or in refrigerator applications where part of the system may be held at low temperature, no lubricant is provided to ease the relative motion of the piston and stationary parts. Indeed, the desirable absence of lubricant is the reason for the development of such resonant "free" pistons, the motion of which is determined not by linkages, but by the sum of forces from gas pressure and electromagnetic fields.

Means to achieve a tight seal between the piston and the fixed parts (typically a cylinder around the piston) are limited to methods that do not demand lubrication. Most commonly, this is met by use of a close clearance fit between the piston body and the cylinder, which impedes the flow past the piston to a near-negligible fraction of the piston's displaced volume. This leakage flow is ideally a fully-reversing flow, with no net mean flow in either direction. However, small variances in the shaping of the clearance gap, such as tapers, rounded entries, etc. can produce a tendency for flow to be preferred in one direction over the other. This leakage can lead to an excess of fluid on one side of the piston. If the piston were restrained in its motion by a linkage, this would appear as increased pressure in the space with excess fluid, with that pressure rising above the pressure of the other space until the differences would drive a reverse flow equal to the leakage, producing a stable zero net flow. In a free piston, though, such a build-up of steady pressure difference across the piston is not sustainable because there is no linkage to hold the piston in position and force the space volumes to be unchanged. Instead, the piston moves, in a steady motion superimposed on its reciprocation, toward the space losing fluid and away from the space accumulating fluid via the seal leakage. This is called 'drift' and can prevent the stable operation of any free-piston machine.

All free-piston systems known to date provide some means to control drift. These include: strong axial springs to provide some of the position fixation a linkage would, but still allowing reciprocation; centerports, which short-circuit the piston seal momentarily in every reciprocation, ideally at a time when the pressures in the spaces ought to be equal (and generating a corrective flow only if they are not); and active controls that sense piston position and operate discrete valves to pump fluid back in opposition to leakage. Axial springs are expensive, high-stress components that impose unwanted secondary (non-axial) forces that impair reliability. Centerports typically cannot be located precisely where the pressures are exactly equal, causing a flow even when not required for drift control. Thus, centerports exact a significant efficiency penalty, and, indeed, are not usable at all in some classes of machines that have large temporal phase differences between piston motion and pressure oscillations (e.g. standing-wave thermoacoustics). Active controls are very expensive and can significantly diminish the reliability, safety, and simplicity of free-piston machines.

The present invention provides a means to passively and automatically correct for the steady leakage effect underlying piston drift without large cost, friction, reliability reduction, or significant efficiency loss.

Various advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is directed to a free-piston device where piston drift is stabilized. A piston having a frequency of reciprocation over a stroke length and with first and second sides facing first and second variable volumes, respectively, for containing a working fluid defining an acoustic wavelength at the frequency of reciprocation. A bypass tube waveguide connects the first and second variable volumes at all times during reciprocation of the piston. The waveguide has a relatively low impedance for steady flow and a relatively high impedance for oscillating flow at the frequency of reciprocation of the piston, so that steady flow returns fluid leakage from about the piston between the first and second volumes while oscillating flow is not diverted through the waveguide. Thus, net leakage about the piston is returned during each stroke of the piston while oscillating leakage is not allowed, and pressure buildup on either the first or second side of the piston is avoided to provide a stable piston location.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION

Free-piston machines offer the potential for power generation products, coolers of all sorts, and dry compressors of pure gasses, if they can be made truly stable and reliable without high cost. Thermoacoustic machines, in particular, promise low-cost micro-generation products if the piston drift can be controlled without high cost or efficiency loss. The present invention provides such a machine.

In a free-piston system such as a thermoacoustic or Stirling engine generator or cooler, containing a reciprocating piston with an imperfect seal to its bore, a bypass tube around the seal is provided in which the tube length is many times the hydraulic diameter of its flow area and ideally substantially equal to a one-half wavelength (or multiples thereof) of the free-propagation of sound in the sealed medium of the device, at the frequency of piston reciprocation. This relationship enables a steady, one-way flow between the spaces on either side of the piston seal, to keep the mean pressures substantially equal in both spaces, but prohibits significant oscillating flow by virtue of its high impedance to oscillating flow at the frequency of reciprocation of the piston.

Figure 1:
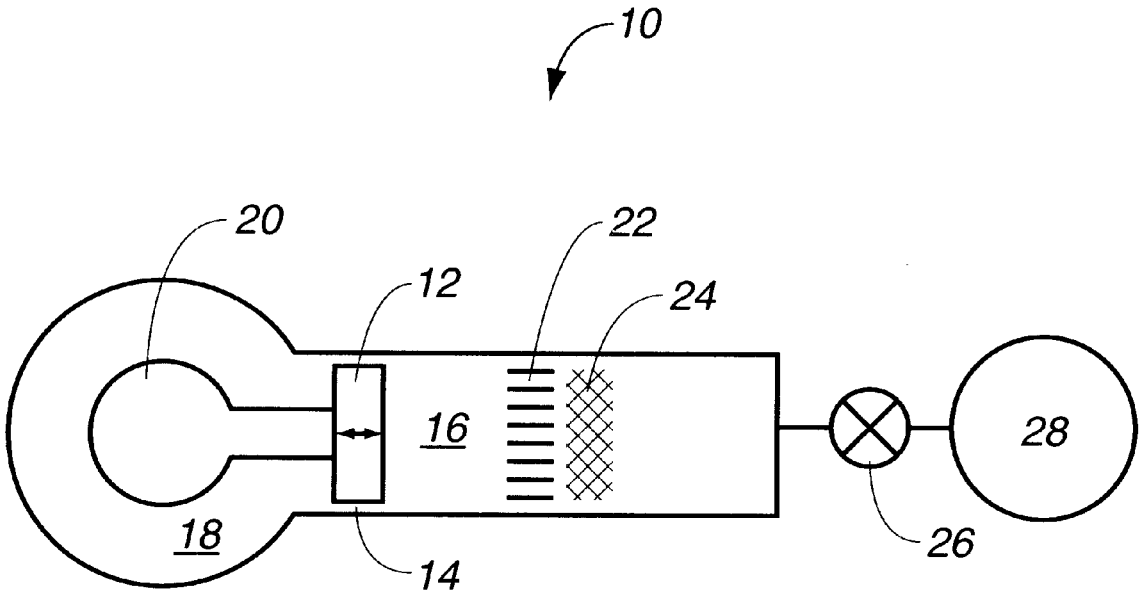
Fig. 1 (PRIOR ART)
FIG. 1 is an illustration of a prior art free-piston device.

A typical prior art free-piston system 10 of interest is depicted in FIG. 1. The key feature of the apparatus has a reciprocating piston 12, working along with an imperfect seal 14, that divides the gas cavity into two sub-volumes 16, 18 or 'spaces.' Typically, there are heat exchangers 22, regenerators 24, and other components, such as motor or generator 20, flow impedance 26, and compliance volume 28, on one or both sides of piston 12, shown in FIG. 1, but these are not part of the present invention.

Generally, when piston 12 moves to the right (toward space 16) the pressure rises in space 16 on the right and falls in space 18 on the left, and when piston 12 moves to the left (toward space 18) the pressure falls in space 16 on the right and rises in space 18 on the left, so that imperfect seal 14 experiences an oscillating pressure difference. Unavoidable asymmetries and differences in the quantity of leakage flow past piston 12 for each half cycle lead to a net leakage through seal 14, smaller than the oscillating leakage but nevertheless significant enough to cause the average pressure to tend to build up on one side of piston 12, pushing the average position of piston 12 away from its desired center position.

Figure 2:
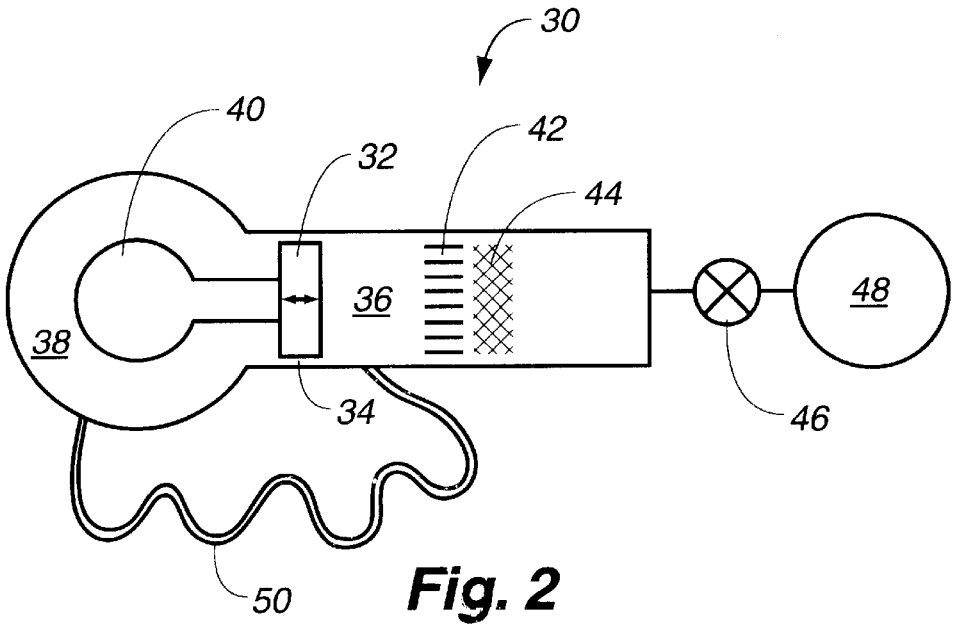
FIG. 2 is an illustration of a free-piston device according to one embodiment of the present invention.

FIG. 2 depicts a free-piston device 30 in accordance with the present invention with bypass tube waveguide 50. A bypass tube waveguide is a flow passage that may have any regular cross-sectional shape, although a simple circular cross section is preferred, with a cross-sectional area and length defining flow impedance values, as discussed below. As shown in FIG. 2, free-piston device 30 includes piston 32 separating volumes 36 and 38 with imperfect seal 34. Motor or generator 40, heat exchanger 42, regenerator 44, flow impedance 46, and compliance volume 48 are included as ancillary components. Piston 32 defines a stroke length during reciprocation between volumes 36 and 38.

Bypass tube waveguide 50 returns the net leakage through imperfect seal 34 without significant build up of an average decentering pressure while not allowing larger oscillating leakage. Bypass tube waveguide 50 supports an acoustic wave between volumes 36 and 38 on either side of piston 32. The acoustic wave has a wavelength defined by the speed of sound in the fluid filling volumes 36 and 38 and bypass tube waveguide 50 at the frequency of reciprocation of piston 32.

The function of bypass tube waveguide 50 is to link the two volumes 36 and 38 at locations that are never covered by piston 32, i.e., volumes 36 and 38 are connected at all times during reciprocation of piston 32. Then, oscillatory pressure waves, delayed by acoustic propagation along bypass tube waveguide 50, reach the ends of bypass tube waveguide 50 in the same phase as the pressure oscillations in volumes 36 and 38 caused by (or causing) the motion of the piston. The connections of bypass tube waveguide 50 to volumes 36 and 38 are not covered by piston 32 when piston 32 reciprocates over the stroke length. If volumes 36 and 38 on the sides of piston 32 are roughly comparable, then the pressure oscillations in volumes 36 and 38 will be roughly equal in magnitude and in antiphase (180° out of phase).

Figure 3A:
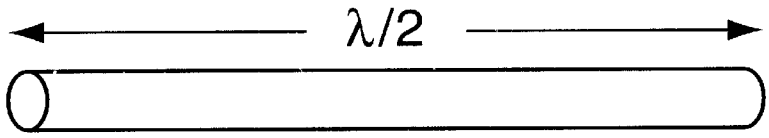
FIGS. 3A–C graphically depict gas pressure and velocity relationships in a half wavelength bypass tube.
Figure 3B:
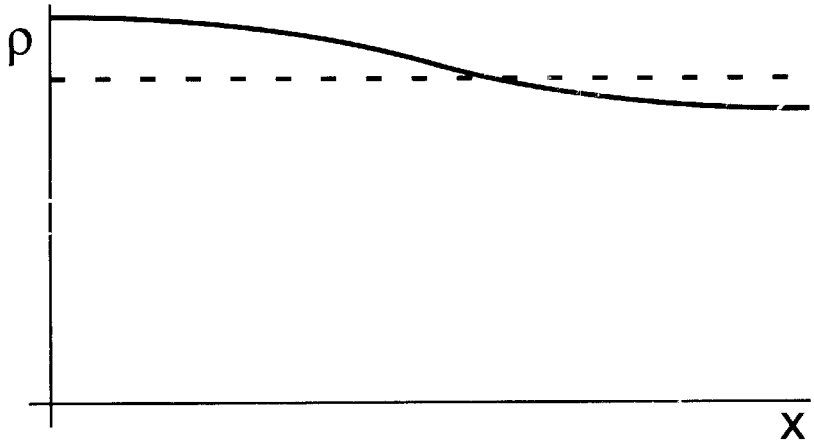
Figure 3C:
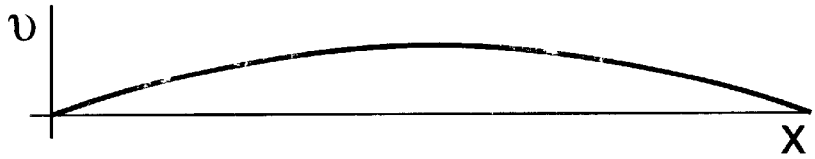

In one embodiment, the best length for the bypass tube waveguide will be ½ of the acoustic wavelength at the frequency of the piston reciprocation because, as illustrated in FIGS. 3A–C, the pressure oscillations at the ends of the ½ wavelength tube are also of the same magnitude and are in antiphase. FIGS. 3B and 3C depict the spatial distribution of pressure p at one instant of time and the oscillatory volume flow rate U a quarter cycle later in time. As shown in FIGS. 3B and 3C, this situation provides no oscillating flow U at either end of the bypass tube waveguide, so the bypass tube waveguide diverts no oscillating flow from the piston. Thus, the bypass tube waveguide provides a relatively high impedance for oscillating flow at the frequency of piston reciprocation. Nevertheless, the bypass tube waveguide presents little resistance to steady (one-way) flow and can allow steady return flow of the net piston-seal leakage without significant net steady pressure difference across the piston. When the tube is designed thusly, no power enters the tube other than what is required to support boundary layer losses from the acoustic waves oscillating within it.

Figures 4A, 4B, 4C:
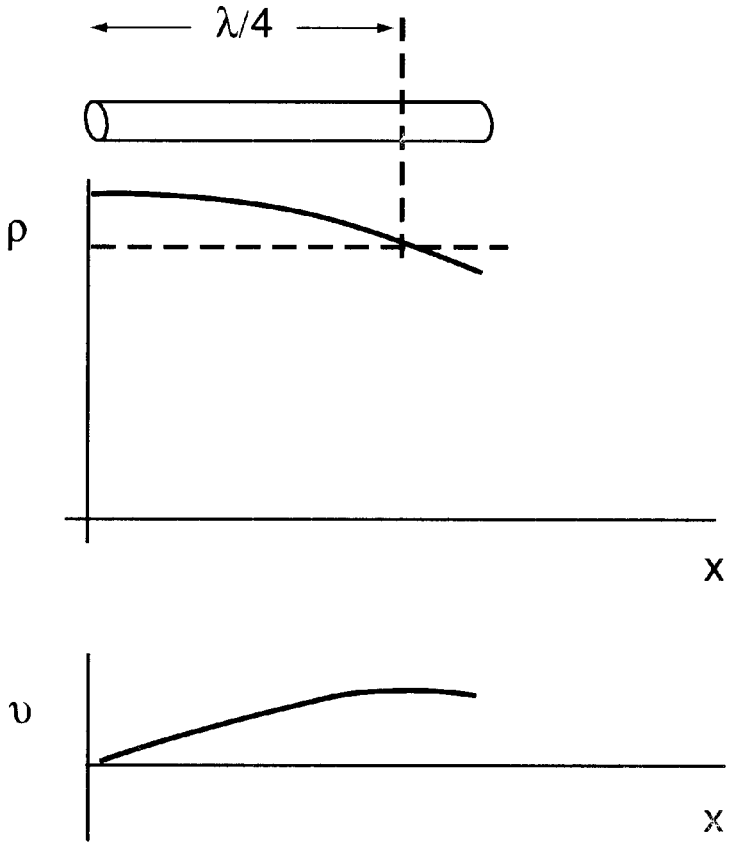
FIGS. 4A–C graphically depict gas pressure and velocity relationships in a quarter wavelength bypass tube.

Different joining points, or different cavity volumes, or intervening components such as regenerators may change the relative magnitudes and/or phasing and hence the ideal length of bypass tube waveguide 50. For example, if the pressure oscillations are 180 degrees out of phase and have greatly different magnitudes, then a shorter bypass tube waveguide, as illustrated in FIGS. 4A–C, satisfies the desired condition. As seen in FIGS. 4B and 4C, the oscillating volume flow at the high-pressure-amplitude end is zero, so the bypass tube waveguide diverts no oscillating flow from the end of the system with high pressure amplitude. This is usually the end of most interest, for example, the end containing heat exchangers.

Figure 5A:
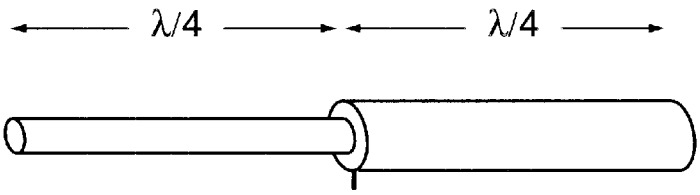
FIGS. 5A–C graphically depict gas pressure and velocity relationships in a composite bypass tube.
Figure 5B:
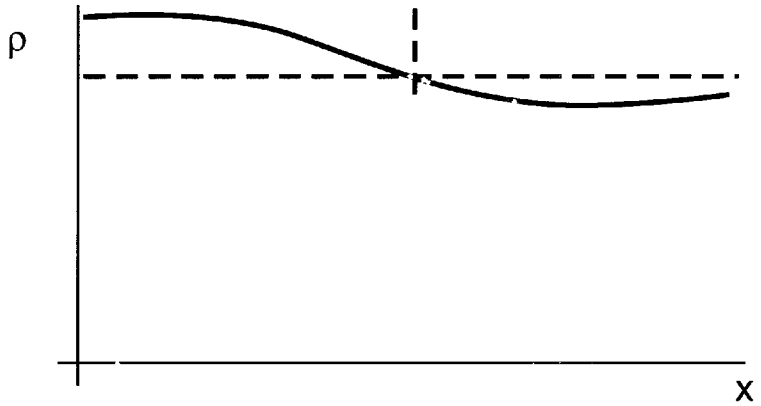
Figure 5C:
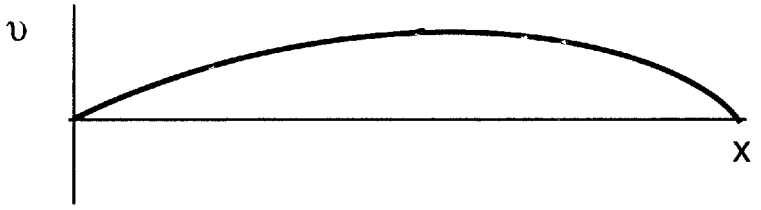

An alternative arrangement to accommodate disparate pressures is depicted in FIGS. 5A–C. As shown in FIG. 5A, two ¼-wavelength waveguides of different diameters are employed to form a bypass tube waveguide, with the ratio of their cross-sectional areas equal to the inverse of the ratio of the pressure amplitudes at their ends. This will in general also match well with the ratio of the volumes on either side of the piston into which the ends couple. FIGS. 5B and 5C show that the oscillatory velocity vanishes at each end of the combined bypass tube as it does for the bypass tube shown in FIG. 3A.

It should also be noted that the entrance and exit locations for the bypass tube need not always be at the locations implied by FIG. 2. In principle, any location that spans both sides of the piston can be made to accomplish the desired result with appropriate acoustical tuning. For example, an internal piston cylinder may be included with a diameter smaller than the outer diameter of the engine. Then the locations need only be across a barrier that separates the volumes on each side of the reciprocating piston. Further, considerations of temperature, for example, may dictate one location over another.

The cross-sectional area of the tube is chosen so that the pressure differential for the steady flow along its length is acceptably low. A large tube will flow freely, but it will generate excessive acoustic power losses due to oscillatory viscous and thermal boundary layer effects. A smaller tube is desirable to minimize acoustic power losses, but if the flow area is too small, unwanted piston drift will result from the pressure difference needed to drive the steady-state flow along the length of the tube.

For a more quantitative and detailed description of these concepts, useful in circumstances other than the ideal circumstances described above, an acoustical point of view is adopted, using the vocabulary [see, e.g., Fundamentals of Acoustics, by L. E. Kinsier, A. R. Frey, A. B. Coppens, and J. V. Sanders, 4th edition, Wiley, 1999] of acoustic resistance, inertance, compliance, impedance, and waveguide to describe the components of the system. The coordinate x measures the distance along the direction of oscillating fluid motion in the waveguide. (The working fluid is typically a gas, but it may be a liquid so the more general term "fluid" is used.) The conventional counter-clockwise phasor notation expresses any time-dependent variable $\xi$ as $$\xi(t) = \xi_m + \mathrm{Re}[\xi_1(x)e^{i\omega t}] \tag{1}$$

with the mean value $\xi_m$ real, and with $\xi_1(x)$ complex to account for both the magnitude and temporal phase of the oscillation at each location x. The angular frequency is $\omega=2\pi f$, where f is the frequency of piston reciprocation, t is time, and $i=\sqrt{-1}$.

Figure 6A:
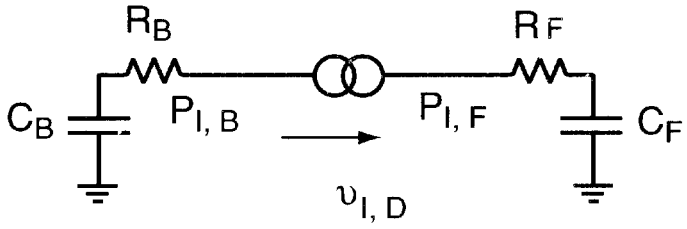
FIGS. 6A and 6B schematically depict the devices shown in FIGS. 1 and 2, respectively, in acoustic circuit format.

In the acoustical point of view, the gas dynamics on the front side "F" and back side "B" of the piston are modeled as equivalent series acoustic resistances R and acoustic compliances C, as shown in FIG. 6A. The piston itself is modeled as an oscillating flow rate source $U_{1D}$. Here, the oscillating leakage flow rate past the piston is neglected, although it can be included if necessary. This model predicts the oscillating pressures on the front and back sides of the piston to be $$p_{1F} = U_{1D}\left(R_F + \frac{1}{i\omega C_F}\right) \tag{2}$$

$$p_{1B} = -U_{1D}\left(R_B + \frac{1}{i\omega C_B}\right) \tag{3}$$

Figure 6B:
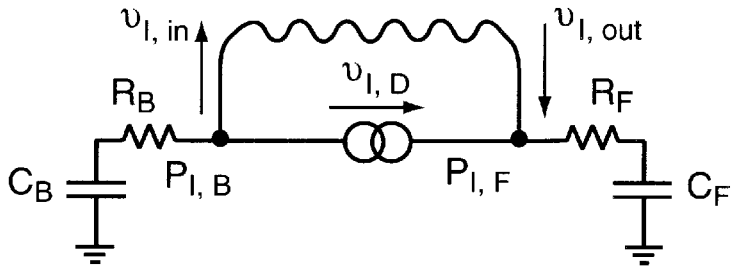

FIG. 6B illustrates an acoustic waveguide connecting the front side "F" and the back side "B" of the piston. The cross-sectional area S of the waveguide must be chosen large enough to carry the undesired piston-leakage net steady flow. An acoustic waveguide obeys the equations $$p_1(x) = p_{1in}\cos kx - i\frac{\omega\rho}{(1-f_v)kS}U_{1in}\sin kx \tag{4}$$

$$U_1(x) = U_{1in}\cos kx - i\frac{(1-f_v)kS}{\omega\rho}p_{1in}\sin kx, \tag{5}$$

which show how oscillating pressure $p_1$ and oscillating volume flow rate $U_1$ evolve with x along the waveguide, given initial values $p_{1in}$ and $U_{1in}$ at x=0. The fluid density is $\rho$ and $\alpha$ is the sound speed. If the wavevector k is real, $k=\omega/\alpha$, and if $f_v=0$, then these equations describe a lossless waveguide, where the acoustic power flow $$\dot{E}_2 = \frac{1}{2}\mathrm{Re}[p_1\tilde{U}_1]$$

is independent of x. The tilde denotes complex confugation, and Re[ ] signifies the real part of the value. Losses in the waveguide, due to kinematic viscosity v and thermal diffusivity $\kappa$ in the fluid, are included by using complex k and non-zero $f_v$:

$$k = \frac{\omega}{\alpha}\sqrt{\frac{1+(\gamma-1)f_k}{1-f_v}} \tag{6}$$

where $\gamma$ is the ratio of isobaric to isochoric specific heats in the fluid and the two f's are geometry-dependent functions. For wide waveguides, the boundary-layer approximation is valid, yielding $$f = \frac{(1-i)\delta}{2r_h} \tag{7}$$

where $r_h$ is the hydraulic radius of the waveguide and the penetration depth $\delta$ is either the viscous penetration $$\delta_v = \sqrt{2\nu/\omega}$$

or the thermal penetration depth $$\delta_\kappa = \sqrt{2\kappa/\omega}.$$

For narrower waveguides, the two f's involve complex Bessel functions in circular waveguides, hyperbolic tangents in parallel-plate waveguides, etc. [For details of these functions, see, e.g., "Thermoacoustic Engines and Refrigerators" by G. W. Swift, in Volume 21 of the Encyclopedia of Applied Physics, pp. 245–264 (Wiley, 1997).]

Setting x=l in Eqs. (4) and (5) produces equations that relate the pressures and volume flow rates at the two ends of the waveguide:

$$p_{1F} = p_{1B}\cos kl - i\frac{\omega\rho}{(1-f_v)kS}U_{1in}\sin kl \tag{8}$$

$$U_{1out} = U_{1in}\cos kl - i\frac{(1-f_v)kS}{\omega\rho}p_{1B}\sin kl \tag{9}$$

Two other equations describing the rest of the system simply state that the combined volume flow rate $U_{1D}+U_{1out}$ drives the impedance of the components on the front side of the piston $$p_{1F} = (U_{1D}+U_{1out})\left(R_F + \frac{1}{i\omega C_F}\right) = (U_{1D}+U_{1out})Z_F \tag{10}$$

and similarly for the components on the back side of the piston $$p_{1B} = -(U_{1D}+U_{1in})\left(R_B + \frac{1}{i\omega C_B}\right) = -(U_{1D}+U_{1in})Z_B \tag{11}$$

where Z is the complex impedance of resistance R and compliance C in series. Note that if the system is an engine-generator, $R_F$ (and/or possibly $R_B$) must be negative, signifying production of acoustic power by the engine. The four coupled equations Eqs. (8) through (11) provide a complete description of the coupled properties of the system in the acoustic approximation.

Eliminating the less interesting variables $U_{1in}$, $U_{1out}$, and $P_{1B}$ by algebraic combination of Eqs. (8) through (11) yields $$p_{1F}\left[-\left(1+\frac{Z_F}{Z_B}\right)\cos kl+\left(\frac{Z_F S(1-f_v)k}{i\omega\rho}-\frac{i\omega\rho}{Z_B S(1-f_v)k}\right)\sin kl\right]= U_{1D}Z_F\left[1-\cos kl-\frac{i\omega\rho}{Z_B S(1-f_v)k}\sin kl\right] \quad (12)$$

This equation confirms the qualitative description given above for simple cases. For example, if k is real, $f_v=0$, and $Z_B=Z_F$, then $p_{1in}$ and $P_{1B}$ have equal amplitudes and are 180 degrees out of phase. In this case, $kl=\pi$, which corresponds to the tube length equal to half a wavelength, provides an obvious solution to Eq. (12), which then reduces simply to $$p_{1F}=U_{1D}Z_F \quad (13)$$

Similarly, if k is real, $f_v=0$, the tube is narrow enough that $Z_F Sk/i\omega\rho$ is negligible, $Z_B$ and $Z_F$ share the same phase, and $|Z_B|<|Z_F|$, then $$\cos kl=-\left|\frac{Z_B}{Z_F}\right| \quad (14)$$

provides a solution to Eq. (12), which again reduces simply to $$p_{1F}=U_{1D}Z_F \quad (15)$$

More complicated situations, such as complex k or different phases for $Z_B$ and $Z_F$, are more difficult to analyze using Eq. (12). Because Eq. (12) is complex, it represents two real equations. Hence, in general, values of the two real variables l and S can be found to satisfy the equation, for a desired $P_{1F}$ and a desired $U_{1D}$. The length l is generally found to be close to (but perhaps smaller than) the value $\lambda/2$ for nearly equal impedances $Z_B$ and $Z_F$, and it is generally found to be close to (but larger than) the value $\lambda/4$ for greatly unequal impedances $Z_B$ and $Z_F$. These rough estimates are useful starting points if Eq. (12) is solved by an iterative numerical procedure or if the best waveguide is found by experimental trial and error.

Those skilled in the art will appreciate that it is often advantageous to deviate from the desired $p_{1F}$ and/or the desired $U_{1D}$ in order to minimize the dissipation of acoustic power in the waveguide. Then it is usually desirable to make the waveguide circular, and to make its cross-sectional area S as small as possible while still allowing enough steady flow to maintain a low steady pressure difference across the piston and hence reduce drift to an acceptable level. In this case, the waveguide length l can be chosen by experimental trial and error or by numerical integration of the equations of motion using a pseudo-one-dimensional gas-dynamics computer code such as DeltaE ["Design Environment for Low-Amplitude Thermoacoustic Engines," W. C. Ward and G. W. Swift, J. Acoust. Soc. Am., vol. 95, pp. 3671–3672 (1994)] or Sage ["A globally implicit Stirling cycle simulation," D. Gedeon, Proceedings of the 21st Intersociety Energy Conversion Engineering Conference, American Chemical Society, 1986, pp. 550].

Those skilled in the art will also appreciate that the smooth variations in the shape of the tubes, at locations such as the ends of the tube, can also be chosen to minimize dissipation of acoustic power.

In all but the most academic cases, the calculation of best geometry for the bypass waveguide is an exercise that cannot be performed analytically. The equations above quickly become intractable when applied to actual devices of interest, and the waveguide design is best performed using an analytical tool such as described above. The following is an example of how such a design might proceed.

In the first reduction to practice of this concept, the DeltaE code was used to develop a waveguide to eliminate piston drift in a thermoacoustic electric generator utilizing a linear alternator coupled to a reciprocating piston in a helium pressure vessel charged to 40 bar. The volume on the front side (containing the thermoacoustic elements) of the piston for this device was 1.27 liters, with a volume on the back side of the piston of 1.0 liter. The operational frequency of the device was 208 Hz. Based on anticipated net leakage past the piston, and available materials, a tube with a constant cross-sectional area of 0.18 $cm^2$ was selected.

At this operating frequency, a ½-wavelength tube would be 265 cm long. When this point was calculated within the DeltaE model, the results quickly indicated that this length was too long, since, at pressure amplitude oscillations of 6 bar, there occurred excess acoustic power flow through the tube of 130 W, and dissipation of 160 W. Application of Eq. 12 indicated that 204 cm, or 39% of one wavelength, was better suited to the two volumes used. DeltaE calculation verified that this length delivers no excess power and completes the bypass with only 124 W of dissipation. It should be noted, however, that tubes shorter and longer than optimum work adequately in most cases, a feature that is of some importance if the operating frequency is not narrowly fixed.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A free-piston device with a piston having a frequency of reciprocation over a stroke length and with first and second sides facing first and second variable volumes, respectively, for containing a working fluid defining an acoustic wavelength at the frequency of reciprocation, the improvement comprising a bypass tube waveguide connecting the first and second variable volumes at all times during reciprocation of the piston and having a relatively low impedance for steady flow and a relatively high impedance for oscillating flow at the frequency of reciprocation of the piston, so that steady flow returns fluid leakage from about the piston between the first and second volumes and piston drift between the first and second volumes is stabilized while oscillating flow is not diverted through the waveguide.

2. The free-piston device of claim 1, wherein the bypass tube waveguide has a length of about one half the acoustic wavelength.

3. The free-piston device of claim 1, wherein the bypass tube waveguide has a length between one half and one quarter of the acoustic wavelength.

4. The free-piston device of claim 1, wherein the bypass tube waveguide is formed of a first tube having a first cross-sectional area and a length of about one quarter of the acoustic wavelength and a second tube having a second cross-sectional area and a length of about one quarter of the acoustic wavelength, where the first and second tubes are joined to form a composite bypass tube waveguide and the ratio of the first and second cross-sectional areas is an inverse of pressure amplitudes at the locations connecting the first and second tubes to the first and second volumes.

5. The free-piston device according to claim 1, 2, 3, or 4, wherein the bypass tube waveguide has a cross-sectional area shaped to minimize acoustic losses along the waveguide while maintaining a pressure difference across the waveguide that does not cause piston drift within the first and second volumes.

6. A method for stabilizing piston drift in a free-piston device with a piston having a frequency of reciprocation over a stroke length and with first and second sides facing first and second variable volumes, respectively, for containing a working fluid defining an acoustic wavelength at the frequency of reciprocation comprising:

connecting the first and second volumes with a bypass tube waveguide at all times during piston reciprocation, where the waveguide has an acoustic impedance effective to permit steady flow between the first and second volumes while not diverting oscillating flow as the piston reciprocates between the first and second volumes.

7. The method of claim 6, further including forming the waveguide to a length about one half the acoustic wavelength.

8. The method of claim 6, further including forming the waveguide to a length between one half and one quarter of the acoustic wavelength.

9. The method of claim 6, further including forming the waveguide from a first tube having a first cross-sectional area and a length of about one quarter of the acoustic wavelength and a second tube having a second cross-sectional area and a length of about one quarter of the acoustic wavelength, where the first and second tubes are joined to form a composite bypass tube waveguide and the ratio of the first and second cross-sectional areas is an inverse of pressure amplitudes at the locations connecting the first and second tubes to the first and second volumes.

10. The method of claim 6, 7, 8, or 9, further including shaping the cross-sectional area of the bypass tube waveguide to minimize acoustic losses along the waveguide while maintaining a pressure difference across the waveguide that does not cause piston drift within the first and second volumes.

* * * * *